US006968880B2

(12) United States Patent
Battaglia et al.

(10) Patent No.: US 6,968,880 B2
(45) Date of Patent: Nov. 29, 2005

(54) LADY'S INTERCHANGEABLE OUTER CARRYING BAG

(75) Inventors: Catherine Jean Battaglia, St. Petersburg, FL (US); Christina B. Xenakis, St. Petersburg, FL (US)

(73) Assignee: Chris Jean, Inc., St. Petersburg, FL (US)

( * ) Notice: Subject to any disclaimer, the term of this patent is extended or adjusted under 35 U.S.C. 154(b) by 276 days.

(21) Appl. No.: 10/647,027

(22) Filed: Aug. 22, 2003

(65) Prior Publication Data

US 2005/0040198 A1 Feb. 24, 2005

(51) Int. Cl.[7] ..... A45C 3/08; A45C 13/30; A45F 3/02; B65D 30/08

(52) U.S. Cl. ..... 150/103; 224/610; 383/111; 150/107; 150/110

(58) Field of Search ..... 150/103, 104, 150/105, 111, 113, 107, 108, 109, 110; 224/162, 224/577, 578, 610, 615, 616, 617, 618; 383/111

(56) References Cited

U.S. PATENT DOCUMENTS

| | | | | | |
|---|---|---|---|---|---|
| 1,960,396 | A | | 5/1934 | Rosenberg | |
| 2,369,239 | A | * | 2/1945 | Khoury | 150/103 |
| 2,437,382 | A | | 3/1948 | Czap | |
| 2,653,640 | A | | 9/1953 | Browning | |
| 2,671,487 | A | | 3/1954 | Vander Hoek | |
| 2,784,756 | A | * | 3/1957 | Resnick | 150/103 |
| 2,804,899 | A | * | 9/1957 | Beattie | 206/260 |
| 3,234,985 | A | | 2/1966 | Gilbert | |
| 3,912,137 | A | * | 10/1975 | Tomatsuri | 224/257 |
| 3,912,141 | A | * | 10/1975 | Appel | 150/108 |
| 4,185,673 | A | * | 1/1980 | Daniello | 383/14 |
| 4,339,062 | A | * | 7/1982 | Witt, Jr. | 224/148.4 |
| 4,929,094 | A | * | 5/1990 | Becker | 383/7 |
| 5,207,254 | A | | 5/1993 | Fromm | |
| 5,503,204 | A | * | 4/1996 | Byers et al. | 150/105 |
| 5,894,975 | A | | 4/1999 | Holden et al. | |
| 5,911,262 | A | * | 6/1999 | Steinhart | 150/103 |
| 6,003,573 | A | | 12/1999 | Owens | |
| 6,095,213 | A | * | 8/2000 | Roegner | 150/106 |
| 6,116,418 | A | * | 9/2000 | Sadow | 206/320 |
| 6,179,025 | B1 | | 1/2001 | Sutton | |
| 6,186,201 | B1 | * | 2/2001 | Salz | 150/105 |
| 6,446,688 | B1 | * | 9/2002 | Sutton | 150/105 |
| 6,543,499 | B2 | | 4/2003 | McCreery | |

(Continued)

*Primary Examiner*—Nathan J. Newhouse
*Assistant Examiner*—Justin M Larson
(74) *Attorney, Agent, or Firm*—Larson & Larson, PA; Herbert W. Larson

(57) ABSTRACT

An inner bag has a D-ring base element integral with a channel on a top edge of each geometrically shaped end wall. A front, back and base panel join the end walls together. Flaps are joined along a top edge of the front and back panel and the two flaps are held together by a zipper to close the top of the inner bag. An outer bag has slightly larger side, front, back and base panels compared to the inner bag. An inside top edge portion of each side panel on the outer bag has a strap forming a slot between the strap and the end panel. The D-rings from an inner bag are slid through the slot to join the inner bag to the outer bag. A top cover flap is attached to a top edge of the back panel of the outer bag and is folded over the top of the outer bag to enclose the inner bag. A strap connected to the D-rings support the connection of the inner and outer bag.

20 Claims, 6 Drawing Sheets

U.S. PATENT DOCUMENTS

2001/0015248 A1 8/2001 McCreery
2002/0012480 A1 * 1/2002 Konno ..... 383/111
2002/0029831 A1 3/2002 Pendergrass
2003/0000612 A1 * 1/2003 Sutton ..... 150/105

* cited by examiner

LADY'S INTERCHANGEABLE OUTER CARRYING BAG

BACKGROUND OF THE INVENTION

This invention relates to a lady's carrying bag. More specifically, it refers to a lady's carrying bag having an inner and outer bag, the inner bag containing desired personal items and the outer bag being interchangeable so that various unique styles and colors can be employed to match a lady's outfit.

Covers for a lady's carrying bag are well known going back to at least 1934. See U.S. Pat. No. 1,960,396. Since that time, many different designs for a lady's carrying bag have been developed. In U.S. Pat. No. 2,437,382, a zipper encloses an inner bag and a row of snap fasteners connect the inner bag to an outer bag. In U.S. Pat. No. 2,653,640, the outer bag has a rigid frame with a pair of arms at each end. There are gussets inside the arms. An inner bag is placed inside the outer bag with pockets slipped over cross members of the inner bag. In U.S. Pat. No. 3,234,985, an outer bag frame has a pair of U-shaped frame channels with hinge elements pivotally securing the channels to one another. Clamps along the channels secure an inner liner. In U.S. Pat. No. 5,207,254, an inner bag is secured to the outer bag by strips of hook and loop fastening material. In U.S. Pat. No. 5,894,975, the inner and outer bag are attached by zippers. In U.S. Pat. No. 6,179,025, an inner bag has a magnetic snap fastener engaging a magnetic snap fastener on the outer bag to hold the inner and outer bag together. Although these described designs all function to hold inner and outer bags together, the mechanism is cumbersome in some instances and in others add substantially to the cost of the handbag. A mechanism for easily and inexpensively connecting the inner bag and outer replaceable bag is needed.

SUMMARY OF THE INVENTION

This invention provides a simple mechanism for joining an inner bag and outer decorative handbag together. Outer bags can be exchanged in seconds so that the bearer can match her handbag to her outfit. The handbag combination of this invention has an inner bag with longitudinally extending front and back walls, a base portion and trapezoidal shaped right and left end walls. A top portion has a centered zipper to seal the top portion together. A top end of each trapezoidal end wall has a tab with an inner channel for enclosing a base of a D-ring, the D-ring engageable with clips on a shoulder strap. The outer bag has longitudinally extending front and back walls connected to a base and trapezoidal end walls, all being slightly larger than corresponding dimensions on the inner bag. An inside wall of a top portion of each end wall has a cloth strip sewn in place to form a slot for receiving the D-ring of the inner bag. A top edge of the back wall has a foldable cover attached so that the cover encloses the top of the outer bag and covers the inner bag located within the outer bag.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Throughout the following detailed description, the same reference numbers refer to the same elements in all figures.

Figure 1:
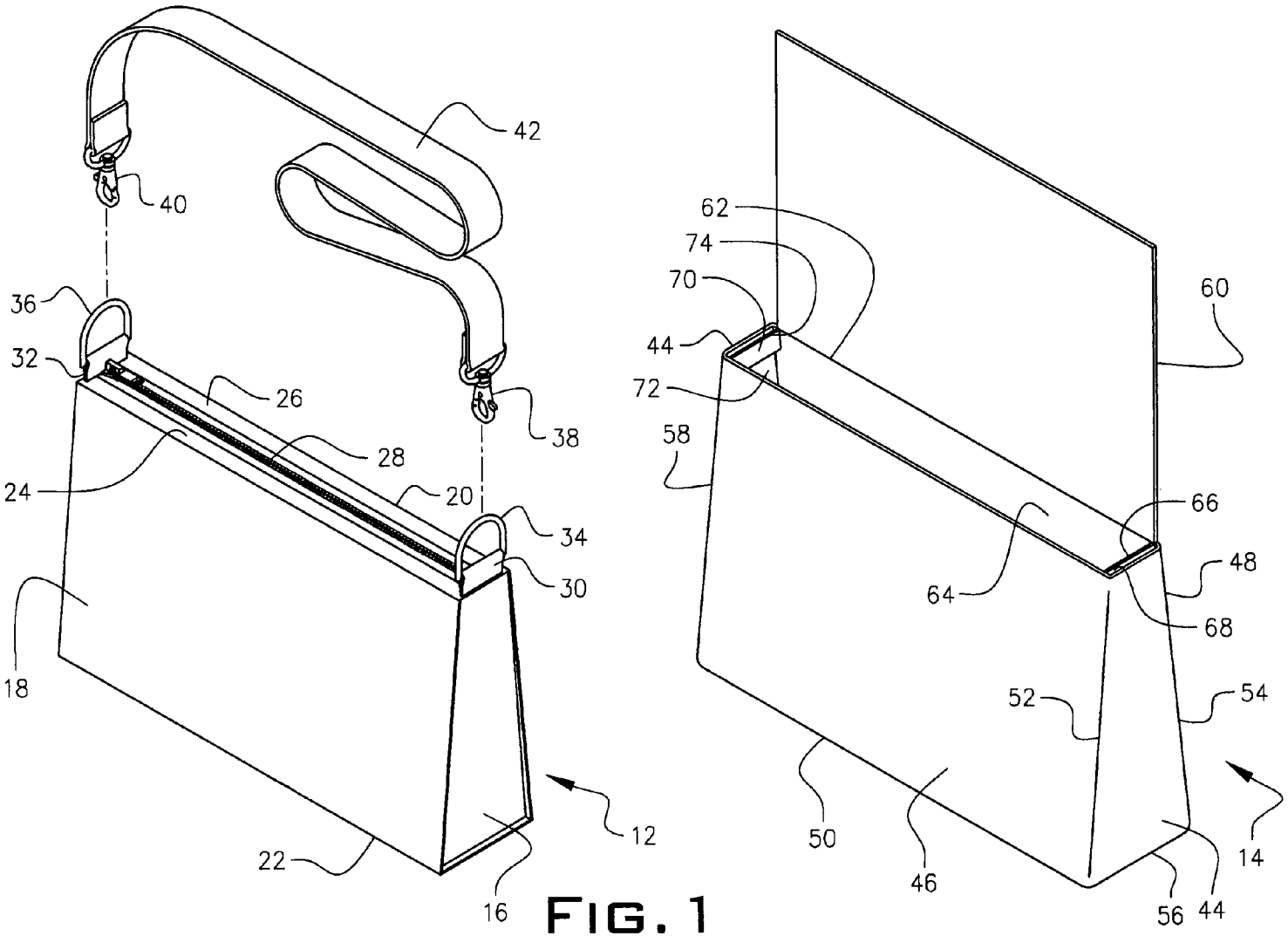
FIG. 1 is a perspective view of the separated inner and outer bag and carrying strap.
Figure 2:
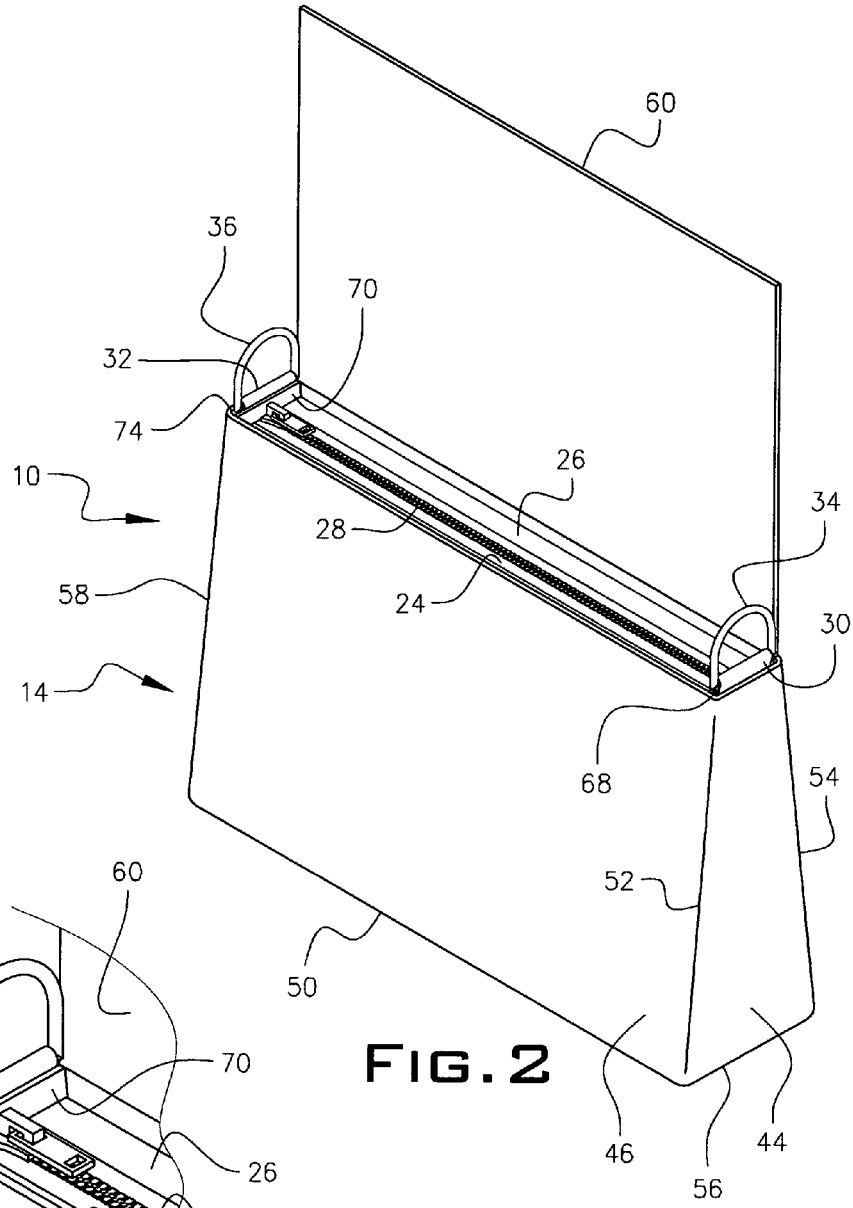
FIG. 2 is a perspective view of the inner bag positioned within the outer bag.
Figure 3:
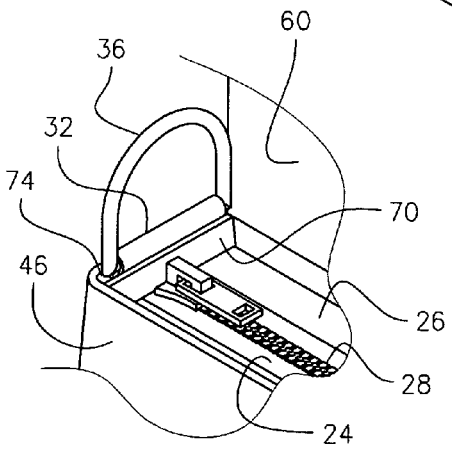
FIG. 3 is an expanded view of the connection between the inner and outer bag.
Figure 4:
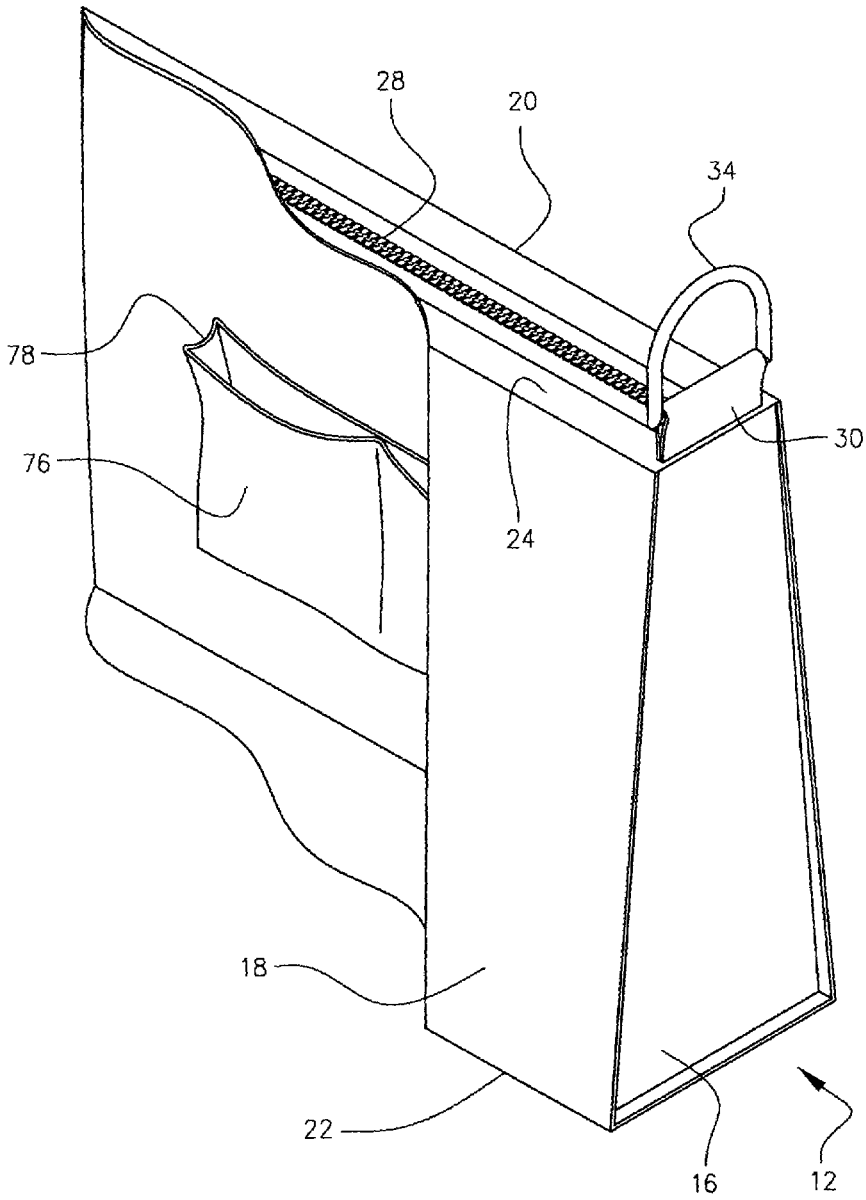
FIG. 4 is a cut-away view of a pocket within the inner bag.
Figure 5:
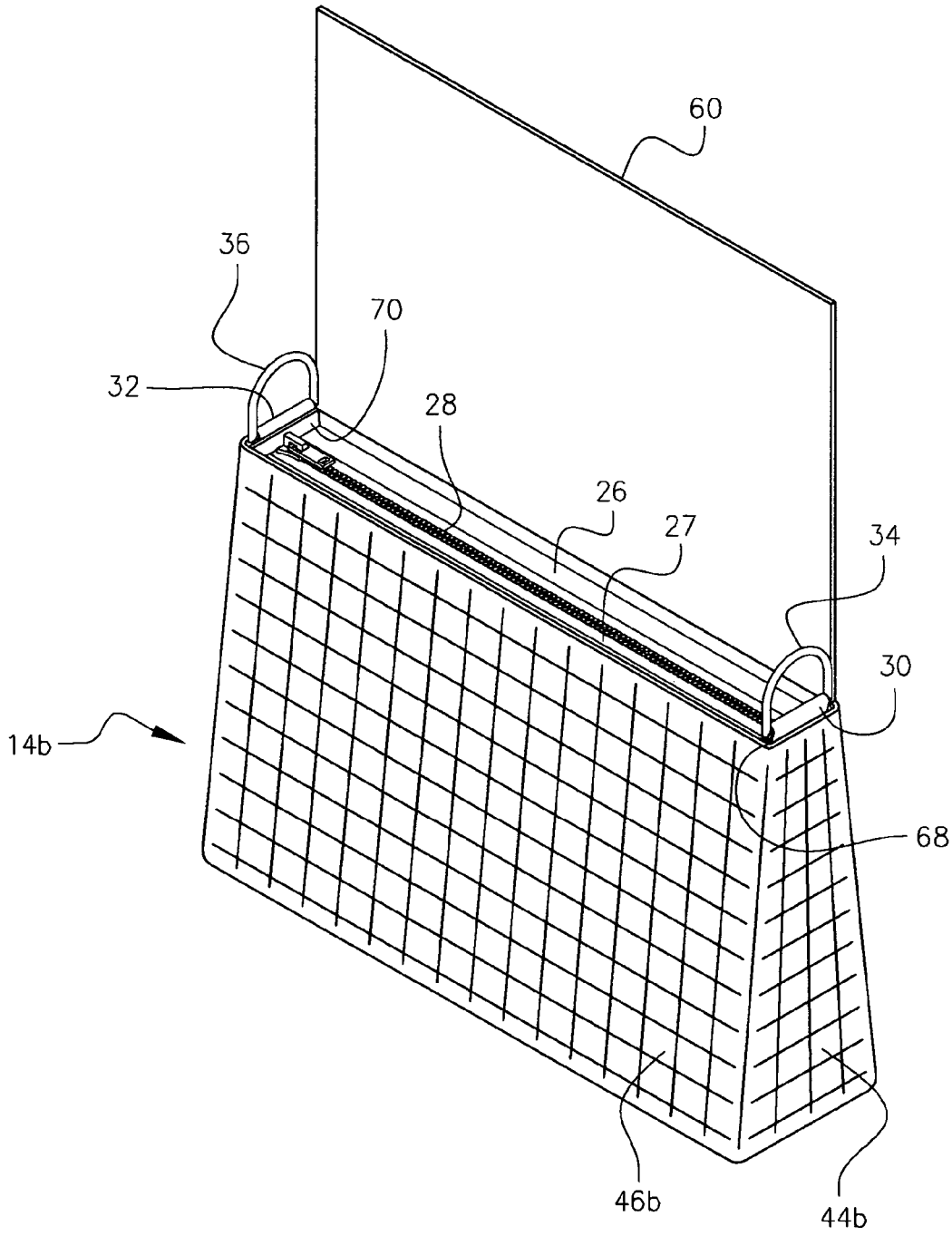
FIG. 5 is a perspective view of the inner bag positioned within an outer bag having an alternate exterior design.

Referring to FIGS. 1–3, the combined handbag 10 has an inner bag 12 and an outer bag 14. The inner bag 12 has oppositely positioned end panels 16 in the shape of a trapezoid. The end panels 16 are joined together by stitching to the end panels 16, an elongated front panel 18, back panel 20 and base panel 22. An elongated closure strap 24 is stitched to a top edge of panel 18. Likewise, an elongated closure strip 26 is stitched to a top edge of panel 20. Closure strips 24 and 26 are joined together with zipper 28 to close a top of inner bag 12. A hollow tab 30 is stitched to a top edge of panel 16. Likewise, a hollow tab 32 is stitched to a top edge of opposite end panel 16. A base portion of D-rings 34 and 36 is enclosed by tabs 30 and 32, respectively. A clip or snap swivel 38 attaches to ring 34 and clip 40 attaches to ring 36 to join strap 42 to the inner bag 12.

Outer bag 14 has oppositely positioned end panels 44, preferably with a trapezoidal shape. Elongated front panel 46, back panel 48 and base panel 50 join the end panels 44 together with stitching along edges 52, 54, 56 and 58. Each of the panels 44, 46, 48 and 50 are slightly larger than the corresponding panels in the inner bag 12. A top flap 60 is stitched to a top edge 62 of back panel 48. Top flap 60 folds on edge 62 to close opening 64 in the outer bag 14. A cloth or leather belt 66 is stitched to an inner wall at a top portion of panel 44 to form a slot 68 for receipt of D-ring 34 attached to inner bag 12. Likewise, belt 70 is stitched to an inner wall 72 at a top portion of oppositely positioned panel 44 to form a slot 74 for receipt of D-ring 36 attached to inner bag 12.

The outer bag 14 can be made of different materials such as leather, cloth, vinyl, or other plastic material. The outer bag 14 can have different exterior designs on panels 44, 46, 48 and 60, including different colors to match the shoes or outfit worn by the bearer. Personal items, money and credit cards are retained in inner bag 12. Inner bag 12 can be easily removed from outer decorative bag 14 by slipping the D-rings 34 and 36 out of slots 68 and 74 and replacing them in a substitute decorative outer bag.

Optionally, the inner bag 12 can be made out of a less expensive cloth or plastic material and can have one or more interior pockets 76 with end gussets 78.

Figure 6:
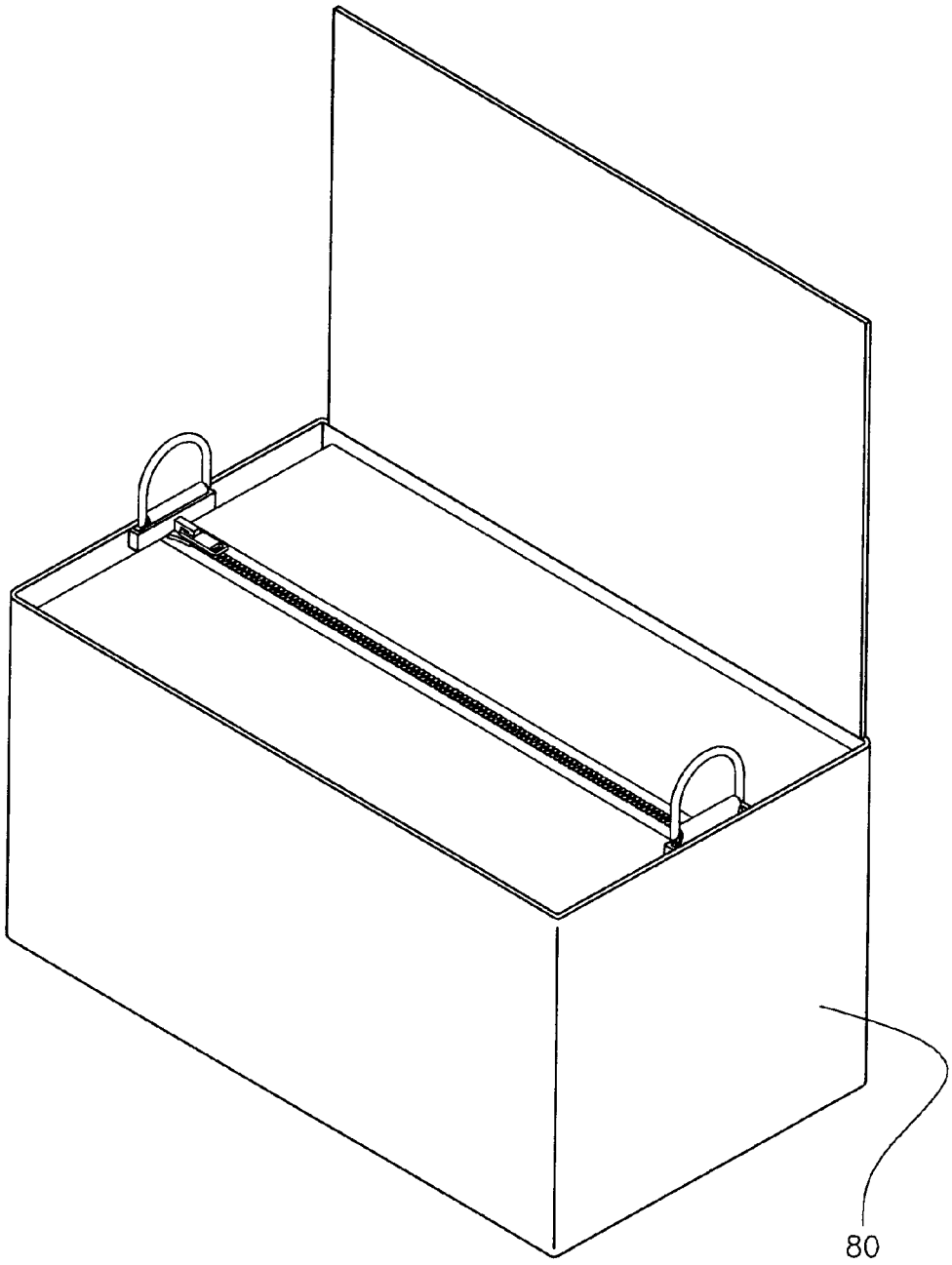
FIG. 6 is a perspective view of an inner bag positioned within an outer bag having a square geometric form at the end panels.
Figure 7:
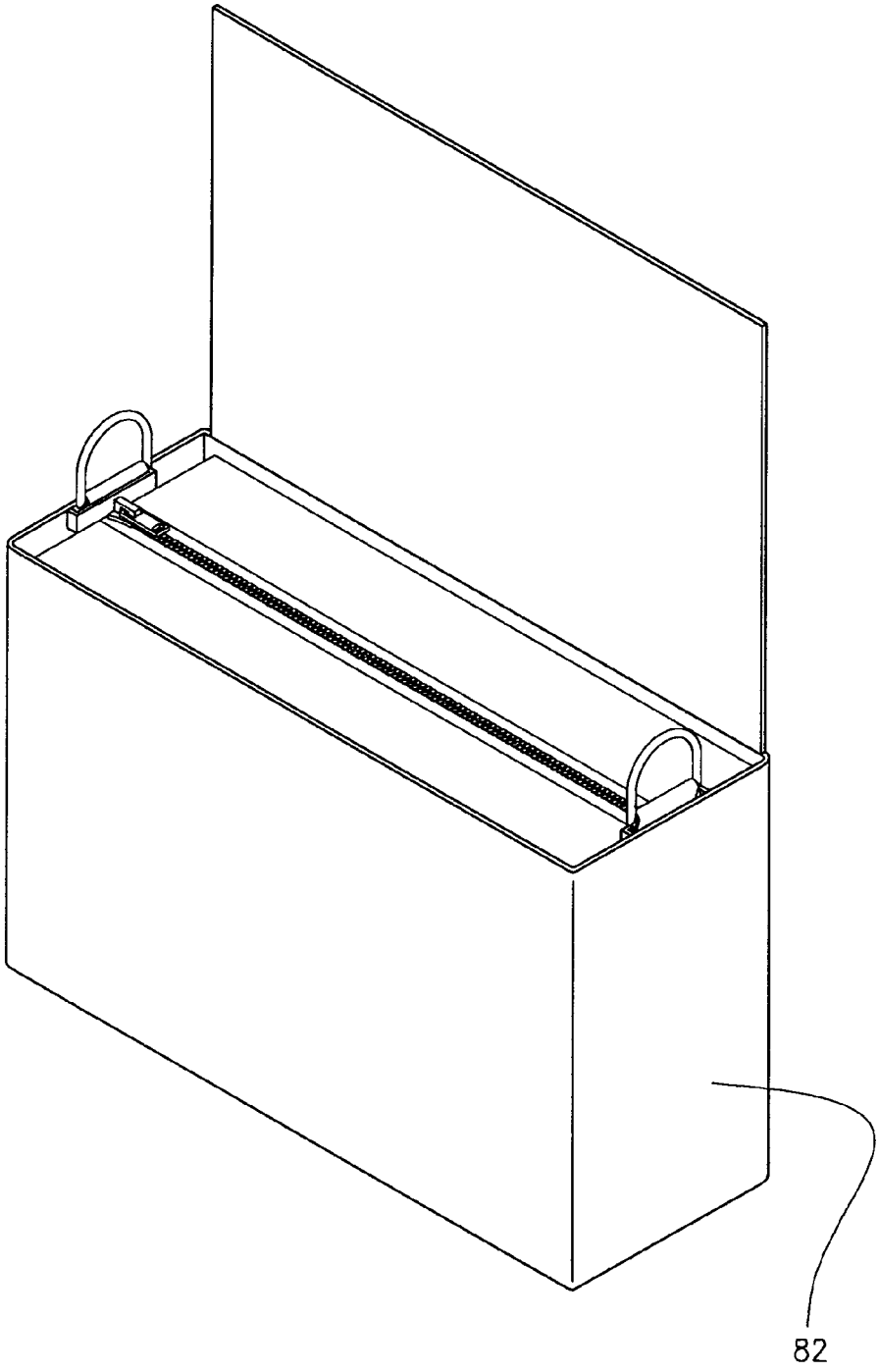
FIG. 7 is a perspective view of an inner bag positioned within an outer bag having a rectangular geometric form at the end panels.

Alternatively, the outer and inner bag can have different geometric shaped side panels such as square 80 or rectangular 82 as seen in FIGS. 6 and 7.

Other equivalent elements can be substituted for the elements disclosed herein to produce the same results in the same way.

Having disclosed the invention, what is claimed follows:

1. A lady's carrying bag comprising:

an inner bag having oppositely positioned geometrically shaped end panels, the end panels joined by an elongated front panel, back panel and bottom panel, a first elongated closure strip stitched on one side edge to a top edge of the front panel and a second elongated closure strip, stitched on one side edge to a top edge of the back panel, the closure strips joined together at a second side edge by an elongated zipper;

a first and second hollow tab connected to a top edge of each oppositely positioned geometrically shaped end panel of the inner bag, a portion of a first and second ring enclosed by the first and second hollow tab, respectively;

an outer bag having oppositely positioned geometrically shaped end panels, an open top portion, an elongated front panel, back panel and bottom panel joining the end panels, the outer bag panels being slightly larger than the corresponding panels in the inner bag;

a top flap integral with the back panel and adapted to be folded over the open top portion of the outer bag;

a belt attached at a first and second end to an inner wall at a top portion of each end panel of the outer bag, each belt spaced apart between the ends from the inner wall to form a slot adapted to receive the rings connected to the inner bag so that the inner bag can be easily inserted or removed from the outer bag; and means for supporting the carrying bag attached to the rings.

2. The lady's carrying bag according to claim 1 wherein the end panels on the inner bag and outer bag have a trapezoid shape.

3. The lady's carrying bag according to claim 1 wherein the end panels on the inner bag and outer bag have a square shape.

4. The lady's carrying bag according to claim 1 wherein the end panels on the inner bag and outer bag have a rectangular shape.

5. The lady's carrying bag according to claim 1 wherein the ring enclosed by each of the first and second hollow tabs on the inner bag is a D-ring.

6. The lady's carrying bag according to claim 1 wherein the inner bag contains a pocket on the front panel or back panel.

7. The lady's carrying bag according to claim 1 wherein the means for supporting the carrying bag is a strap connected to the first and second ring.

8. The lady's carrying bag according to claim 7 wherein the strap is connected to the first and second ring by a first and second snap swivel, respectively.

9. An interchangeable outer decorative bag in combination with a smaller inner bag containing personal items, the combination of bags comprising:

the smaller inner bag having oppositely positioned end panels, the end panels joined by an elongated front panel, back panel and bottom panel;

a first and second closure strip, the first closure strip attached on a first side edge to a top edge of the front panel, the second closure strip attached on a first side edge to a top edge of the back panel, the first and second closure strips joined together at a second side edge by a zipper;

a first and second hollow tab connected to a top edge of each oppositely positioned end panel of the smaller inner bag, a portion of a first and second ring enclosed by the first and second hollow tab, respectively;

an outer bag having oppositely positioned end panels, an open top portion, a front, back and bottom panel joining the end panels, the outer bag panels being slightly larger than the corresponding panels in the inner bag;

a top flap integral with the back panel and adapted to be folded over the open top portion of the outer bag;

a belt attached at a first and second end to an inner wall at a top portion of each end panel of the outer bag, each belt spaced apart between the first and second end from the inner wall to form a slot adapted to receive the rings connected to the smaller inner bag so that the smaller inner bag can be easily inserted or removed from the outer bag; and a means for supporting the outer bag attached to the rings.

10. The interchangeable outer decorative bag in combination with the smaller inner bag according to claim 9 wherein the end panels of the outer and inner bags are trapezoidal in shape.

11. The interchangeable outer decorative bag in combination with the smaller inner bag according to claim 9 wherein the end panels of the outer and inner bags are square in shape.

12. The interchangeable outer decorative bag in combination with the smaller inner bag according to claim 9 wherein the end panels of the outer and inner bags are rectangular in shape.

13. The interchangeable outer decorative bag in combination with the smaller inner bag according to claim 9 wherein the ring enclosed by each of the first and second hollow tabs on the inner bag is a D-ring.

14. The interchangeable outer decorative bag in combination with the smaller inner bag according to claim 9 wherein the inner bag contains a pocket on the front or back panel.

15. The interchangeable outer decorative bag in combination with the smaller inner bag according to claim 9 wherein the means for supporting the outer bag is a strap connected to the first and second ring.

16. The interchangeable outer decorative bag in combination with the smaller inner bag according to claim 9 wherein the outer bag is made from leather.

17. The interchangeable outer decorative bag in combination with the smaller inner bag according to claim 9 wherein the outer bag panels are connected by stitching.

18. An outer carrying bag containing a removable inner bag comprising:

the inner bag having oppositely positioned end panels, the end panels joined by an elongated front panel, back panel and bottom panel, a top edge of the front and back panels attached to a first side of a first and second closure strip, respectively, the second side of the first and second closure strips joined together by a zipper;

a first and second hollow tab connected to a top edge of each oppositely positioned end panel of the inner bag, a portion of a first and second ring enclosed by the first and second hollow tab, respectively;

the outer bag having oppositely positioned end panels, an open top portion, a front, back and bottom panel joining the end panels, the outer bag panels being slightly larger than the corresponding panels in the inner bag;

a flap attached to a top edge of the back panel and adapted to be folded over the open top portion of the outer bag;

a belt attached at a first and second end to an inner wall at a top portion of each end panel of the outer bag each belt spaced apart between the first and second end from the inner wall to form a slot adapted to receive the rings connected to the inner bag so that the inner bag can be inserted or removed from the outer bag; and a carrying strap attached at each end to the rings attached to the inner bag.

19. The outer carrying bag containing the removable inner bag according to claim 18 wherein the end panels of the outer and inner bags are trapezoidal in shape.

20. The outer carrying bag containing the removable inner bag according to claim 18 wherein the outer bag has decorative displays on the front and back panels.

* * * * *